US008534105B2

(12) United States Patent
Shibata

(10) Patent No.: US 8,534,105 B2
(45) Date of Patent: Sep. 17, 2013

(54) BENDING METHOD, AND DIE AND BENDING MACHINE USED FOR THE BENDING METHOD

(75) Inventor: Takahiro Shibata, Kanagawa (JP)

(73) Assignee: Amada Company, Limited, Kanagawa (JP)

( * ) Notice: Subject to any disclaimer, the term of this patent is extended or adjusted under 35 U.S.C. 154(b) by 1179 days.

(21) Appl. No.: 11/719,486

(22) PCT Filed: Nov. 16, 2005

(86) PCT No.: PCT/JP2005/021033
§ 371 (c)(1),
(2), (4) Date: Jul. 30, 2009

(87) PCT Pub. No.: WO2006/054596
PCT Pub. Date: May 26, 2006

(65) Prior Publication Data

US 2009/0293576 A1 Dec. 3, 2009

(30) Foreign Application Priority Data

| | | |
|---|---|---|
| Nov. 17, 2004 | (JP) | 2004-333594 |
| Dec. 15, 2004 | (JP) | 2004-363445 |
| Aug. 25, 2005 | (JP) | 2005-244464 |
| Aug. 25, 2005 | (JP) | 2005-244542 |

(51) Int. Cl.
*B21C 51/00* (2006.01)

(52) U.S. Cl.
USPC ..... 72/31.1; 72/31.01; 72/31.11; 72/389.3; 72/389.6; 72/702

(58) Field of Classification Search
USPC ..... 72/19.8, 19.9, 20.1, 20.2, 21.4, 21.5, 72/31.11, 389.3, 389.4, 389.5, 389.6, 31.1, 72/31.01, 702
See application file for complete search history.

(56) References Cited

U.S. PATENT DOCUMENTS 5,293,767 A * 3/1994 Sartorio ..... 72/311
5,497,647 A 3/1996 Nagakura (Continued)

FOREIGN PATENT DOCUMENTS

JP 60-099013 7/1985
JP 9-295052 11/1987

(Continued)

OTHER PUBLICATIONS

Japan Technology Transfer Association, "Press-kata sekkei Shinryosyu", Kabushiki Kaisha Omusha Shoten , Jun. 1965, pp. 67, Fig. 10.

(Continued)

*Primary Examiner* — Dana Ross
*Assistant Examiner* — Homer Boyer
(74) *Attorney, Agent, or Firm* — Greenblum & Bernstein, P.L.C

(57) ABSTRACT

A bending machine having: a punch and a die for bending a sheet-shaped work; pressurizing means which pressurizes the work in a space between the punch and the die by vertically moving a ram; inputting means (23) which inputs die information on the punch and the die, material information on the work and bending information; a database (25) which stores data on a pressure per unit length required for bending the work; calculating means (29) which calculates a pressure necessary for the pressurizing means based on various information inputted from the inputting means (23) and on the data on the pressure stored in the database (25); and controlling means (31) which controls the pressurizing means based on a result of calculation by the calculating means (29).

4 Claims, 10 Drawing Sheets

(56) References Cited

U.S. PATENT DOCUMENTS

| | | | | |
|---|---|---|---|---|
| 5,839,310 | A * | 11/1998 | Tokai et al. | 72/31.1 |
| 5,857,366 | A * | 1/1999 | Koyama | 72/31.1 |
| 5,983,688 | A * | 11/1999 | Anzai et al. | 72/15.1 |
| 6,047,579 | A * | 4/2000 | Schmitz | 72/15.1 |
| 6,161,408 | A * | 12/2000 | Ooenoki et al. | 72/31.01 |
| 6,539,763 | B1 | 4/2003 | Chebbi | |
| 7,089,774 | B2 * | 8/2006 | Takahashi | 72/389.3 |
| 7,392,678 | B2 * | 7/2008 | Niwa et al. | 72/31.01 |
| 2006/0162408 | A1 | 7/2006 | Niwa et al. | |
| 2007/0186602 | A1 * | 8/2007 | Cella | 72/31.1 |

FOREIGN PATENT DOCUMENTS

| | | |
|---|---|---|
| JP | 01-186219 | 7/1989 |
| JP | 2-063610 | 3/1990 |
| JP | 4-157022 | 5/1992 |
| JP | 5-329553 | 12/1993 |
| JP | 7-024530 | 1/1995 |
| JP | 7-039939 | 2/1995 |
| JP | 8-155553 | 6/1996 |
| JP | 9-085350 | 3/1997 |
| JP | 09-295052 | 11/1997 |
| JP | 2001-001049 | 1/2001 |
| JP | 2001-121297 | 5/2001 |
| JP | 2003-504208 | 2/2003 |
| JP | 2003-088918 | 3/2003 |
| JP | 2003-191019 | 7/2003 |
| JP | 2005-193240 | 7/2005 |

OTHER PUBLICATIONS

Ota, "Zukai Press-kata Kozo to Sono Sekkei", 3 Han, The Nikkan Shinbun, Ltd. , Dec. 1988, pp. 134, 10.4(2), Hyojun Keishiki.

Search report from Japan, mail date is Oct. 2010.

Amada Sheet Metal Laboratory, "Bending Tool: New Sheet Metal Working Know-How 2", Machinist Publishing Company, First Edition, Mar. 20, 1980, pp. 6-10, and English language Abstract.

Amada Sheet Metal Laboratory, "Bending Tool: New Sheet Metal Working Know-How 2", Machinist Publishing Company, First Edition, Mar. 20, 1980, p. 7, and English language Abstract.

Japanese Office Action forJP Application No. 2005-244464 with mail date Jan. 24, 2012.

Japanese Office Action for JP Application No. 2005-244542 with mail date Jan. 24, 2012.

Japan (JP Application No. 2005-244464) Office action, mail date is May 24, 2011.

Japan (JP Application No. 2005-244542) Office action, mail date is May 24, 2011.

English language Abstract of JP 4-157022.

English language Abstract of JP 2003-088918.

English language Abstract of JP 9-295052.

English language Abstract of JP 2-063610.

English language Abstract of JP 2003-191019.

English language Abstract of JP 5-329553.

English language Abstract of JP 9-085350.

English language Abstract of JP 2001-001049.

English language Abstract of JP 8-155553.

English language Abstract of JP 7-039939.

Japan Technology Transfer Association, "Press-kata sekkei Shiryosyu," Kabushiki Kaisha Omusha Shoten, Jun. 1, 1965, p. 67, fig.10.

Ota, "Zukai Press-kata Kozo to Sono Sekkei," 3 Han, The Nikkan Kogyo Shinbun, Ltd., Dec. 10, 1988, p. 134, "10.4(2): Hyojun Keishiki".

* cited by examiner (A)

(B)

BENDING METHOD, AND DIE AND BENDING MACHINE USED FOR THE BENDING METHOD

TECHNICAL FIELD

The present invention relates to a bending method applicable when a sheet-shaped work is bent into a V shape with a bending machine such as a press brake, a die and a bending machine used for the bending method. Specifically, the present invention relates to a bending method used to bend a work while suppressing an over-bending amount of a work to a small amount, and to a die and a bending machine used for the bending method.

BACKGROUND ART

When a sheet-shaped work is bent by installing a die having a V-shaped bending groove and a punch having a tip end formed into a shape corresponding to the bending groove to a bending machine such as a press brake, there are processing methods including air bending (free bending), bottoming (pressure bending), coining (high pressure bending), and the like.

The air bending is the processing method configured to bend a sheet-shaped work into a V shape by pressuring and bending the work with the tip end portion of the punch, the work being supported at two points respectively of two shoulders on the V-shaped bending groove in the die. This air bending can bend the work at various desired angles by using combinations of the punch and the die, but has a problem of a large spring-back amount.

In bending a work by the bottoming, a work is sandwiched and pressed between the V-shaped bending groove in the die and the punch. However, when a work is bent at, for example, 90°, this method is configured to use the die having an angle of the V groove, for example, equal to 88° or 89° so as to perform bending to form 90° as the work shows spring-back. In this case, although the spring-back amount is smaller than the case of the air bending, the spring-back amount is not always stabilized constantly. Accordingly, there is a problem for bending a work at higher accuracy.

In bending a work by the coining, a high pressure is applied to the work, the pressure being about 5 to 8 times greater than the case of the air bending so as to eliminate the spring back of the work, and thereby to transfer the shapes of the punch and the die to the work. As a result, a frame of the bending machine is apt to cause large strain, and accordingly there is a problem that it is necessary to increase the frame rigidity.

Here, a precedent example concerning the bending machine to perform bending by air bending and coining is disclosed in JP-A 2001-1049 (Patent Document 1). Meanwhile, precedent examples concerning the air bending are disclosed in JP-A 8-155553 (Patent Document 2) and JP-A 7-39939 (Patent Document 3).

According to the invention disclosed in Patent Document 1, when a work is subjected to coining by use of a bending machine such as a press brake, a ram is descended until the value of a deviation counter exceeds a threshold for coining, which is stored in an NC device in advance, and the descending action of the ram is terminated when the value exceeds the threshold by considering a position of the ram at this time as a bottom dead center of the coining ram. Accordingly, there may be a case where the coining is terminated at a degree of a bending work corresponding to the bottoming, and there is a problem that the coining may be terminated without providing the work with a pressure sufficient to transfer the shapes of the die and the punch to the work.

The invention according to Patent Document 2 is premised on bending a work by the air bending or the bottoming, and does not have an assumption on bending by the coining configured to apply a high pressure to the work, the pressure being 5 to 8 times greater than that of the air bending.

Specifically, suppose the concept of bending a work by controlling an engagement positional relation between the punch and the die as similar to the air bending or the bottoming is applied to the coining. This leads to a problem such as a shortage of pressure application or breakage of the die due to an excessive pressure application along the variation in thicknesses of the works attributable to, for example, manufacturing errors. This is because the coining is configured to apply a high pressure to a work in order to transfer the shapes of the punch and the die to the work.

The invention according to Patent Document 3 is aimed at improving accuracy of the bending angles of multiple points of a work by measuring angles at two points on left and right sides of the work while the work is detached from a die after a first session of bending is completed, and by calculating stroke correction amounts for left and right drive shafts based on differences from respective target angles when the measured angels do not match the target angles, and then by performing correction. However, the invention according to Patent Document 3 relates to the air bending, and is configured to perform positional control of a ram. Accordingly, it is difficult to apply this technique directly to the bottoming or the coining.

Incidentally, the air bending is also referred to as three-point bending because it is possible to change a bending angle for a work in terms of a positional relation among three points of two shoulders of the V-shaped bending groove in the die and the tip end of the punch.

This bending method has a problem of a large spring-back amount of the work. The bottoming is configured to sandwich the work between inclined planes of the V groove in the die and inclined planes of the punch. Although the spring-back amount is reduced, there is a problem with controlling the bending angle for the work more accurately. The coining is configured to apply a higher pressure (5 to 8 times greater than the case of the air bending) to the work after sandwiching the work between the inclined planes of the V groove in the die and the inclined planes of the punch, and is thus possible to process the angle for the work accurately, but has a problem that the rigidity of the frame of the bending machine (the press brake) must be increased.

Particularly, in the invention according to Patent Document 1, when a sheet-shaped work is bent into the V shape by use of the die having the V-shaped bending groove and the punch, the air bending and the coining are performed by using the same die. Accordingly, at the time of coining, the work is strongly high-pressured (pressurized) with all the surfaces of the inclined planes of the bending groove in the die and the inclined planes on the tip end side of the punch. Thus, the pressure at the time of the coining becomes extremely high, the pressure for transferring, to the work, the inclined angle of the inclined planes of the bending groove in the die and the inclined angle of the inclined planes on two sides on the tip end of the punch. For this reason, it is necessary to increase the frame rigidity.

In the meantime, a configuration of a die which appears to be similar at the glance to the die according to the present invention is disclosed in JP-A 9-295052 (Patent Document 4). The invention described in this Patent Document 4 is based on aspects that the rate of progression of initial wear is not stabilized quickly if a curvature radius of a shoulder of a die is as small as about 0.8 mm, and that the wear at the shoulder of the die is stabilized when works are bent 2000 times or more, for example, and is configured to form a curved surface at the shoulder of the die along a curved line equivalent to the shoulder after bending 2000 times. The curvature radius at that point becomes equal to 0.99 mm, which is quite small.

In other words, the invention according to the aforementioned publication of patent application does not intend to form the portion of a V-shaped bending groove in the die above the approximately intermediate depth position into a convex curved surface having a large radius of curvature, for example, and does not relate to the present invention at all.

Moreover, in the bottoming, the spring-back still exists though the spring-back amount is smaller than that of the air bending. Accordingly, when a target bending angle is set, for example, equal to 90°, the inclined angle of the V-shaped bending groove in the die is set to a slightly smaller angle than 90° (such as 88°) in expectation of the spring-back amount. On the other hand, the coining is the process to transfer, to a work, the inclined angles of the bending groove (the V groove) in the die and of the punch, and is configured to apply a high pressure to the work. For this reason, in an attempt to bend a work accurately at an angle of, for example, 90° by the coining, the use of the die used for the air bending or the bottoming may result in bending at an angle equal to the angle that is preset in expectation of the spring-back amount. Accordingly, it is not possible to achieve bending at an angle targeted originally.

Therefore, in order to bend a work by the coining, it is necessary to form the angle of the V groove in the die and tip end angle of the punch to the target angles (such as 90°) in advance. Since the coining is configured to transfer, to the work, the angle of the V groove in the die and the tip end angles of the punch, it is possible to bend the work accurately, and thus the coining is desirable. However, as mentioned previously, this is configured to apply the high pressure (5 to 8 times greater than the case of the air bending), and there is a demand for achieving the coining with less pressure.

The present invention has been made to solve the foregoing problems, and a first object of the present invention is to provide a bending method, a die and a bending machine used for the bending method, which are capable of applying a pressure to a work without excess or deficiency, and accurately performing a bending process to transfer shapes of a punch and a die to the work.

A second object of the present invention is to provide a bending method, a die and a bending machine used for the bending method, which are capable of reducing a pressure for bending by applying a pressure to a work locally.

A third object of the preset invention is to provide a bending method, a die and a bending machine used for the bending method, which are capable of suppressing a pressure to a small amount by reducing a bending-back amount of a work.

DISCLOSURE OF THE INVENTION

To attain the first object, a first aspect of the present invention is a bending method for sandwiching and bending a sheet-shaped work in a space between a V-shaped bending groove in a die installed to a bending machine and a tip end portion of a punch installed to the bending machine, the method including the steps of: obtaining a pressure per unit length from a pressure required for bending a work subjected to bending in advance; calculating a necessary pressure for bending a new work based on the obtained pressure and a length of a bending line of the new work subject to bending; and bending the new work by use of the calculated pressure.

A second aspect of the present invention is a bending method for sandwiching and bending a sheet-shaped work in a space between a V-shaped bending groove in a die installed to a bending machine and a tip end portion of a punch installed to the bending machine, the method including the steps of: obtaining a pressure per unit length from a pressure required for bending a work subjected to bending in advance; calculating a required total pressure for bending a work based on the obtained pressure and a length of a bending line of a new work subject to bending, or calculating total pressure theoretically based on die information, material information, and bending information; calculating a pressure to be applied by pressurizing means provided on both of left and right sides of the bending machine based on the calculated the total pressure and a layout position of the new work relative to the bending machine; calculating amounts of strain of two side frames of the bending machine, the strain being caused by the pressure from the pressurizing means on both of the left and right sides; calculating an inclined angle of a ram supporting any of the die and the punch based on the calculated amounts of strain of the two side frames; inclining the ram in an opposite direction in advance to correct the calculated inclined angle of the ram; and bending the work by pressurizing and driving the ram with the pressurizing means while maintaining the inclined state.

A third aspect of the present invention is a bending machine having a punch and a die for bending a sheet-shaped work, a ram rendered vertically movable for vertically moving any of the punch and the die, and pressurizing means which pressurizes the work in a space between the punch and the die by vertically moving the ram, the method including: inputting means which inputs die information on the punch and the die, material information on a work, and bending information; a database which stores data on a pressure per unit length required for bending the work; calculating means which calculates a pressure necessary for the pressurizing means based on various information inputted from the inputting means and on the data on the pressure stored in the database; and controlling means which controls the pressurizing means based on a result of calculated by the calculating means.

A fourth aspect of the present invention is a bending machine having a punch and a die for bending a sheet-shaped work, a ram rendered vertically movable for vertically moving any of the punch and the die, and pressurizing means which pressurizes the work in a space between the punch and the die by vertically moving the ram, the pressurizing means provided on both left and right sides of the bending machine, the bending machine including: inputting means which inputs die information on the punch and the die, material information on a work, and bending information; a database which stores data on a pressure per unit length required for bending various works; first calculating means which calculates a total pressure required by the pressurizing means based on the various information inputted from the inputting means and on the data on the pressure stored in the database; second calculating means which calculates a pressure necessary for the left and right pressurizing means based on the total pressure calculated by the first calculating means and on layout position information on the work relative to the bending machine; third calculating means which calculates amounts of strain of two side frames of the bending machine based on a result of calculation by the second calculating means, and which calculates an inclined angle of the ram; and controlling means which controls the left and right pressurizing means to correct the inclined angle of the ram, calculated by the third calculating means, to an opposite inclined angle, and which controls the left and right pressurizing means based on the result of calculation by the second calculating means.

A fifth aspect of the present invention is a bending machine having a punch and a die for bending a sheet-shaped work, a ram rendered vertically movable for vertically moving any of the punch and the die, and pressurizing means which pressurizes the work in a space between the punch and the die by vertically moving the ram, the bending machine including: inputting means which inputs die information on the punch and the die, material information on a work, and bending information; calculating means which calculates a pressure necessary for bending the work based on the die information, the material information, and the bending information; and controlling means which controls the pressurizing means based on a result of calculation by the calculating means.

A sixth aspect of the present invention is a bending machine having a punch and a die for bending a sheet-shaped work, a ram rendered vertically movable for vertically moving any of the punch and the die, and pressurizing means which pressurizes the work in a space between the punch and the die by vertically moving the ram, the pressurizing means provided on both left and right sides of the bending machine, the bending machine including: inputting means which inputs die information on the punch and the die, material information on a work, and bending information; first calculating means which calculates a total pressure necessary for bending the work based on the various information inputted from the inputting means; second calculating means which calculates a pressure necessary for the left and right pressurizing means based on the total pressure calculated by the first calculating means and on layout position information on the work relative to the bending machine; third calculating means which calculates amounts of strain of two side frames of the bending machine based on a result of calculation by the second calculating means, and which calculates an inclined angle of the ram; and controlling means which controls the left and right pressurizing means to correct the inclined angle of the ram, calculated by the third calculating means, to an opposite inclined angle, and which controls the left and right pressurizing means based on the result of calculation by the second calculating means.

Therefore, according to the bending methods and the bending machines based on the first aspect to the sixth aspect, the pressure per unit length is obtained from the pressure required for bending the work subjected to bending in advance, then the pressure necessary for bending is obtained by use of the pressure per unit length and the length of the bending line of the work, and the work is pressurized by the punch and the die by applying the pressure obtained as described above. Hence it is possible to pressurize the work without excess or deficiency, and to perform bending accurately to transfer the shapes of the punch and the die to the work.

To attain the second object, a seventh aspect of the present invention is a bending method for bending a sheet-shaped work, the method including the steps of: pressing a work placed on a die provided with a V-shaped bending groove by use of a punch; and when sandwiching and pressurizing the work in a space between inclined planes provided on the bending groove and inclined planes provided on the punch, locally pressurizing only both side portions close to a bending line defined by bending the work into a V shape by use of the inclined planes provided only in the vicinity of a bottom of the bending groove and the inclined planes in the vicinity of a tip end of the punch An eighth aspect of the present invention is a bending method for bending a sheet-shaped work, the bending method including the steps of: pressing a work placed on a die provided with a V-shaped bending groove by use of a punch; and when sandwiching and pressurizing the work in a space between inclined planes provided on the bending groove and inclined planes provided on the punch, performing pressurization while increasing, but not decreasing, a pressure from initiation of bending the work until sandwiching and pressurizing the work in the space between the inclined planes of the bending groove and the inclined planes of the punch.

A ninth aspect of the present invention is a bending method for bending a sheet-shaped work, the bending method including the steps of: pressing a work placed on a die provided with a V-shaped bending groove by use of a punch; and when sandwiching and pressurizing the work in a space between inclined planes provided in the vicinity of a bottom of the bending groove and inclined planes provided in the vicinity of a tip end of the punch, gradually moving positions for supporting the work on one side surface and the other side surface of the bending groove in the die toward the bottom of the bending groove; and locally pressurizing the work by ultimately sandwiching and pressurizing the work by use of the inclined planes of the bending groove and the inclined planes of the punch.

A tenth aspect of the present invention is a die for bending a sheet-shaped work, which includes: upper surfaces; and a V-shaped bending groove, and in which a contact plane on an uppermost part of a curved surface connected to contact inclined planes provided on both sides in the vicinity of a bottom of the bending groove as well as the upper surface is a plane coinciding with the upper surface, a contact plane on a lowermost part of the curved surface is a plane coinciding with the inclined plane, and the curved surface is a convex curved surface having a curvature radius on a lower side greater than a curvature radius on an upper side.

An eleventh aspect of the present invention is a die for bending a sheet-shaped work, which includes: upper surfaces; and a V-shaped bending groove, and in which concave portions are provided between inclined planes provided on both sides in the vicinity of a bottom of the bending groove and curved surfaces connected so as to contact the upper surfaces.

A twelfth aspect of the present invention is a die for bending a sheet-shaped work, which includes: inclined surfaces located on a bottom side of a bending groove formed in a die body, and configured to locally pressurize a work while cooperating with inclined planes provided on a tip end side of a punch, and in which both side surfaces provided on the bending groove extending from upper parts of the inclined plane to upper surfaces of the die body are formed into surfaces in an arbitrary shape located outside contact planes being in contact with the inclined planes.

A die based on a thirteenth aspect of the present invention is the die based on any one of the tenth aspect to the twelfth aspect, in which about $2 \leqq A/B \leqq 4$ is satisfied where a width dimension of uppermost parts of the bending groove is defined as A, and an upper interval dimension of the inclined planes is defined as B.

Therefore, according to the bending methods and the dies based on the seventh aspect to the thirteenth aspect, the sheet-shaped work is bent by being sandwiched and locally pressurized in a space between the inclined planes in the vicinity of the bottom of the V-shaped bending groove provided in the die and the inclined planes provided on the punch. Hence, it is possible to reduce the pressure for bending as compared to the case of sandwiching and bending the work by using the entire inclined planes of the bending groove in the die.

To attain the third object, a fourteenth aspect of the present invention is a processing method for bending a sheet-shaped work into a V shape by use of a die having a V-shaped bending groove formed at a target angle in advance and a punch rendered freely engageable with the bending groove, the method including the steps of: over-bending the work slightly above the target bending angle when sandwiching and pressurizing the work in a space between inclined planes of the bending groove and inclined planes of the punch; and thereafter bending the work at the target bending angle by sandwiching and pressurizing the work in the space between the inclined planes of the bending groove and the inclined planes of the punch.

A fifteenth aspect of the present invention is a bending die including: a die having a V-shaped bending groove; and a punch rendered freely engageable with the bending groove, in which an angle of the bending groove and a tip end angle of the punch are formed equal to a target bending angle applicable to a sheet-shaped work, and a tip end R of the punch is formed into a radius slightly smaller than an inner R of the work when a bending angle for the work reaches the target bending angle for the first time after initiation of bending the work with the die and the punch.

A bending die based on a sixteenth aspect of the present invention is the bending die according to the fifteenth aspect, in which the tip end R of the punch is approximately equal to 8 mm.

Therefore, according to the bending method and the bending dies based on the fourteenth aspect to the sixteenth aspect, it is possible to reduce an over-bending amount at the time of bending the work. Hence, it is possible to reduce a bending-back amount and thereby to suppress the pressure to a small value.

BEST MODES FOR CARRYING OUT THE INVENTION

Hereinafter, the best modes for carrying out the present invention will be described based on FIG. 1 to FIG. 15.

Figure 1:
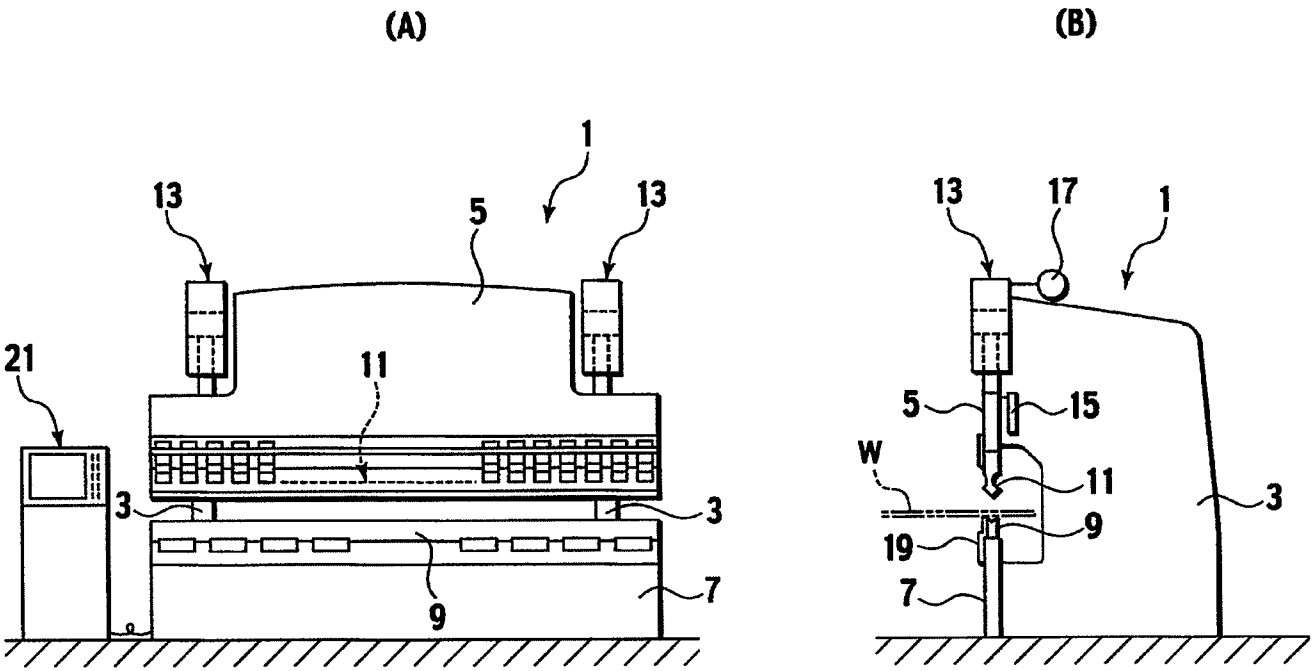
FIG. 1 is a conceptual and schematic view for explaining a bending machine according to a first embodiment of the present invention.

Referring to FIG. 1, a press brake 1 as an example of a bending machine for bending a sheet-shaped work W includes left and right side frames 3 having a C shape. An upper table 5 and a lower table 7 are provided in front of these side frames 3 so as to face each other vertically. Moreover, a die (a lower mold) 9 is installed to an upper part of the lower table 7, and a punch (an upper mold) 11 for bending the work W in cooperation with the die 9 is installed to a lower part of the upper table 5.

As it is well known, a V-shaped bending groove (a V groove) for bending the work W is formed on an upper side of the die 9, and a tip end side (a lower end side) of the punch 11 is formed into a V shape corresponding to the V groove in the die 9. Thus, it is possible to bend the work W into a V shape by disposing the work W in a space between the die 9 and the punch 11 and by engaging the punch 11 with the die 9.

As described previously, in order to bend the work W by engaging the punch 11 with the die 9, an appropriate one of the upper table 5 and the lower table 7 is rendered vertically movable as a ram. In this example, the upper table 5 is rendered vertically movable as the ram, and ram driving means (pressurizing module) 13 having appropriate configurations such as hydraulic cylinders or ball screw mechanisms are installed to the left and right side tables 3 to move the upper table (ram) 5 vertically. Accordingly, the work W is pressurized with the die 9 and the punch 11 by driving the left and right ram driving means 13 as the pressurizing means (module) and by bringing the ram 5 down thereby to achieve bending.

In order to detect a vertical position of the punch 11 relative to the ram 9 when the ram 5 is moved vertically as described above, position detecting means (module) 15 such as linear sensors for detecting vertical positions on both of left and right sides of the ram 5 are provided on both of the left and right sides. Moreover, appropriate pressure detecting means (module) 17 such as pressure sensors for detecting a pressure from the left and right ram driving means (the pressurizing module) 13 to the work W when the work W is bent are independently provided on the left and right sides. Furthermore, bending angle detecting means (module) 19 for detecting a bending angle for the work W are provided on the appropriate number of positions on the lower table 7. In addition, the press brake 1 includes a control unit (module) 21 such as a CNC unit for control overall operations.

In the above-described configuration, the work W is bent by controlling the ram driving means 13 to descend the ram 5 under control of the control unit 21 and thereby pressing the work W on the die 9 into the V groove in the die 9 with the punch 11. In this case, the state where three points of both shoulders of the V groove in the die 9 and a tip end portion of the punch 11 contact the work W corresponds to the bending by the air bending, while the state where the work W is sandwiched between the V groove in the die 9 and the tip end side of the punch 11 corresponds to the bending by the bottoming. Moreover, the way of bending configured to press the work W stronger than the state of the bottoming so as to transfer the V shapes of the die 9 and the punch 11 to the work corresponds to the bending by the coining.

Incidentally, the coining is conventionally configured to apply a high pressure to the work W, is the pressure being about 5 to 8 times greater than the case of the air bending. It is not always true that the required minimum pressure is applied to the work W, and there may be a case of applying an excessively high pressure to the work W, and occasionally causing breakage of the die 9.

For this reason, the bending machine 1 according to this embodiment has a configuration capable of performing the bottoming or the coining by always applying an appropriate pressure to the work W when the work W is bent by means of the bottoming or the coining.

Figure 2:
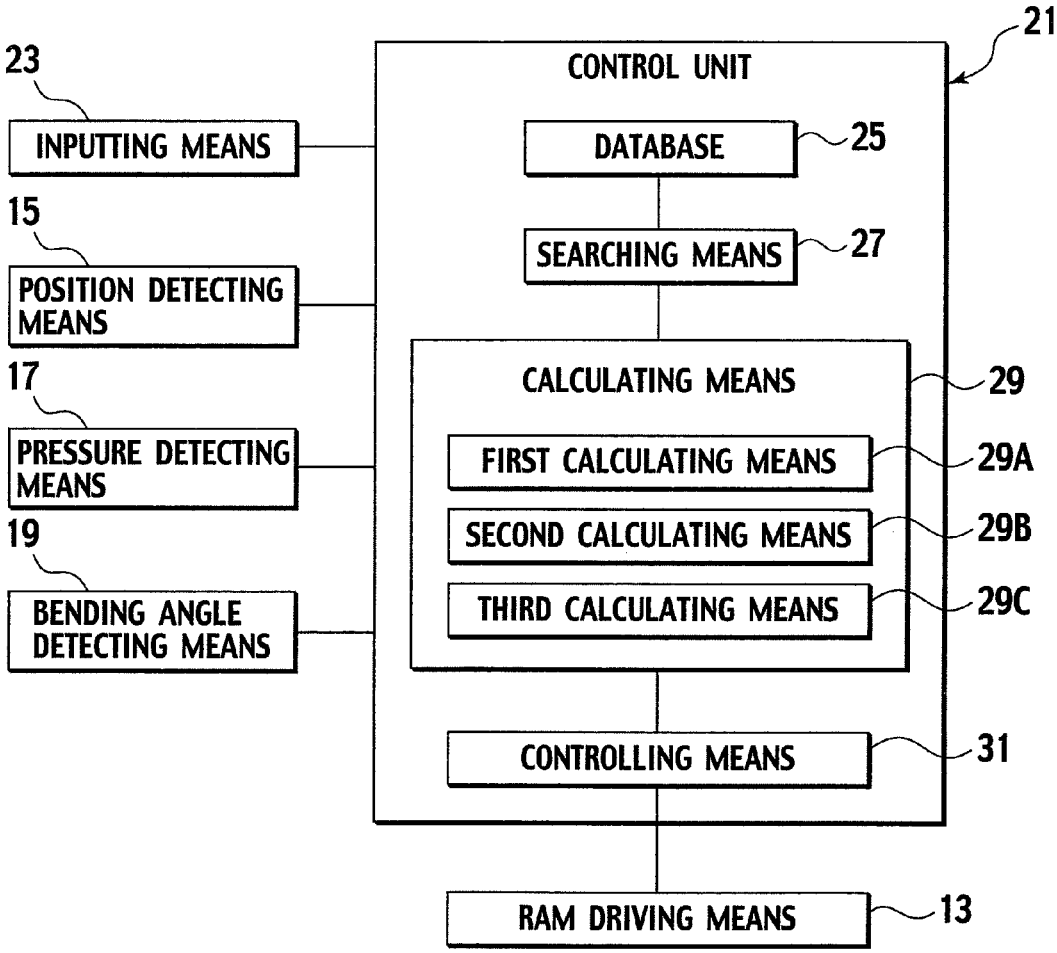
FIG. 2 is a functional block diagram showing functions of a control unit.
Figure 3:
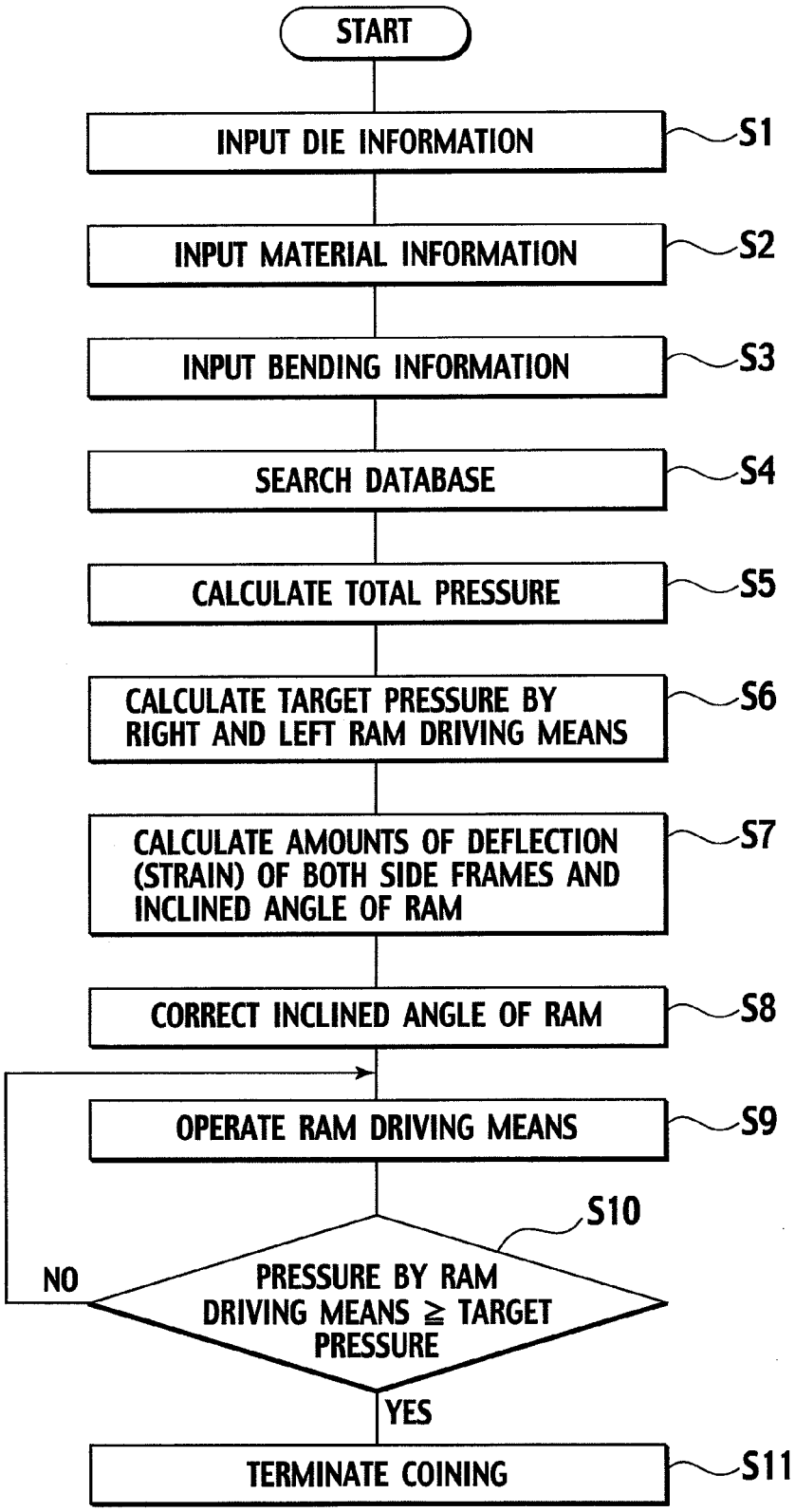
FIG. 3 is a flowchart for explaining operations.

Specifically, as shown in FIG. 2, inputting means (module) 23 for inputting, for example, die information on the die 9 and the punch 11, material information on the work W and bending information is connected to the control unit 21, and the position detecting means 15, the pressure detecting means 17 and the bending angle detecting means 19 are connected thereto.

The die information includes a minute radius at the tip end portion of the punch 11, an angle on the tip end side thereof, a V-width dimension of the V groove in the die 9, an angle of the V groove thereof, minute radii of the shoulders of the V groove, and the like. The material-information on the work W includes a sheet thickness, the material, and the like, while the bending information includes a bending angle for the work W, a bending length, a bending position (a layout position in a left-to-right direction of the bending machine 1), and the like.

The control unit 21 includes a database 25 and searching means (module) 27 for searching the database 25 based on the information inputted from the inputting means 23. The database 25 stores data on an appropriate pressure per unit length required for subjecting the work W to the bottoming or the coining, and the data were obtained when the work W such as a test piece was subjected to the bottoming or the coining on trial by use of the punch 11 and the die 9 constituting the pair are stored in the database 25. The data on the appropriate pressure are the data linking the die information on the punch 11 and the die 9 constituting the pair with the material information on the work W such as the material or the sheet thickness. Thus, it is possible to search the data on the appropriate pressure if acquiring die numbers of the punch 11 and the die 9 constituting the pair or the die information in the case of forming a set of the punch 11 and the die 9, and the material information on the work W such as the material or the sheet thickness.

Moreover, the control unit 21 includes calculating means (module) 29 for performing various calculation based on the various information inputted from the inputting means 23 and the data on the pressure searched from the database 25, and controlling means (module) 31 for controlling the ram driving means 13 based on a result of calculation by the calculating means 29.

In the above-described configuration, when the die information, the material information and the bending information are inputted from the inputting means 23 (Steps S1, S2 and S3), the searching means 27 searches the database 25 (Step S4) to search the appropriate pressure per unit length for performing the bottoming or the coining in response to the inputted die (the punch 11 and the die 9) and the work W.

When the appropriate pressure per unit length is searched out as described above, a total pressure for the work W subjected to the bottoming or the coining is calculated by first calculating means (module) 29A in the calculating means 29 (Step S5) based on this appropriate pressure and the bending length of the material, and target pressures by the left and right ram driving means 13 are calculated by second calculating means (module) 29B (Step S6) by use of the position information (the layout position information) in the left-to-right direction for the work W subjected to the bottoming or the coining.

Specifically, when the work W is located at the central part in the left-to-right direction for performing the bottoming or the coining, the values of the target pressure applied by the left and right ram driving means 13 become equal. When the work W is located, for example, on the right side of the central part for performing the bottoming or the coining, the target pressure applied by the right ram driving means 13 usually becomes greater than the target pressure applied by the left ram driving means 13. In this case, the total pressure is usually divided in inverse proportion to a distance from the central part in the left-to-right direction of the work W to the left to right ram driving means 13.

As described above, the values of the target pressures respectively applied by the left and right ram driving means 13 are calculated, and subsequently third calculating means (module) 29C calculates amounts of deflection (strain) of the left and right side frames 3, which are attributable to reactive forces upon application, to the work W, of the pressures equivalent to the target pressures respectively from the left and right ram driving means 13, and an inclined angle of the ram 5 is calculated based on a result of this calculation (Step S7). The inclined angle of the ram 5 is equivalent to the inclined angle caused by the reactive force at the time of coining the work W. Accordingly, the inclination of the ram 5 is corrected to an opposite inclined angle relative to the inclined angle so as to correct the calculated inclined angle in advance (Step S8). This correction of the inclined angle of the ram 5 is achieved by correcting the inclination as the result of calculation by the third calculating means 29C to opposite inclination, and then by individually controlling and driving the left and right ram driving means 13 by use of the controlling means 31 based on this correction. Note that the inclined angle of the ram 5 is available based on values detected by the left and right position detecting means 15.

After the correction of the inclined angle of the ram 5 is performed as described above, each of the left and right ram driving means 13 is operated (driven) under the control of the controlling means 31 while the corrected inclined angle is maintained, and the ram 5 is descended to start the bottoming or the coining of the work W (Step S9). Thereafter, the values of the pressures caused by the left and right rain driving means 13 are respectively detected by the pressure detecting means 17 so as to judge whether or not the detected values of the pressures respectively become equal to the values of the target pressures (Step S10). when the detected pressures becomes equal to the target pressures, the bottoming or the coining is terminated (Step S11) on the assumption that the appropriate pressure for the bottoming or the coining has been applied to the work W.

As is understood from the above-mentioned explanation, when the bottoming or the coining is performed on the work W, the total pressure necessary for bottoming or coining the work W is obtained based on the appropriate pressure per unit length stored in the database 25 in advance, and then the bottoming or the coining can be performed by means of the pressure control for controlling the pressure of the left and right ram driving means 13. Accordingly, it is possible to perform the bottoming or the coining of the work W always at the appropriate pressure while avoiding the state where the pressure is too small or too large. In addition, it is possible to perform the bottoming or the coining efficiently without damaging the die.

Meanwhile, when the work W is deviated in the left-to-right direction, the inclined angle of the ram 5 is obtained and then the bottoming or the coining of the work W is performed while the ram 5 is set to the opposite inclination in advance so as to correct this inclined angle. Accordingly, in comparison with the case of correcting the inclination of the ram 5 at the time of the bottoming or the coining, it is easier to correct the inclined angle of the ram 5 and is also possible to perform accurate correction. Hence it is possible to carry out the bottoming or the coining with high work-passage accuracy.

Incidentally, the present invention is not limited only to the above-described embodiment, and can be embodied by carrying out appropriate modifications. In other words, the above description shows the example of storing the data on the pressure per unit length required for bottoming or coining the work in the database. Nevertheless, it is also possible to apply a configuration described below.

Specifically, the calculating means for calculating the pressure necessary for the bottoming or the coining of the work based on the die information on the punch and the die, the material information on the work, and the bending information is provided herein, and the die information, the material information, and the bending information are inputted from the inputting means 23 to the calculating means, and then the total pressure necessary for the bottoming or the coining of the work is calculated. Thereafter, the pressures required for the right and the left pressurizing means 13 can be calculated based on the calculated total pressure and the layout position information on the work, and the pressure control of the left and right pressurizing means 13 can be performed by setting the opposite inclination so as to correct the inclination of the ram as similar to the above-described embodiment.

In other words, in order to achieve the pressure control of the pressurizing means 13 when the bottoming or the coining is performed on the work, it is possible to calculate the total pressure based on the data on the pressure stored in the database, or to calculate the total pressure theoretically by use of a theoretical formula (an experimental formula) stored in a memory in advance and based on the die information, the material information, and the bending information.

Figure 4:
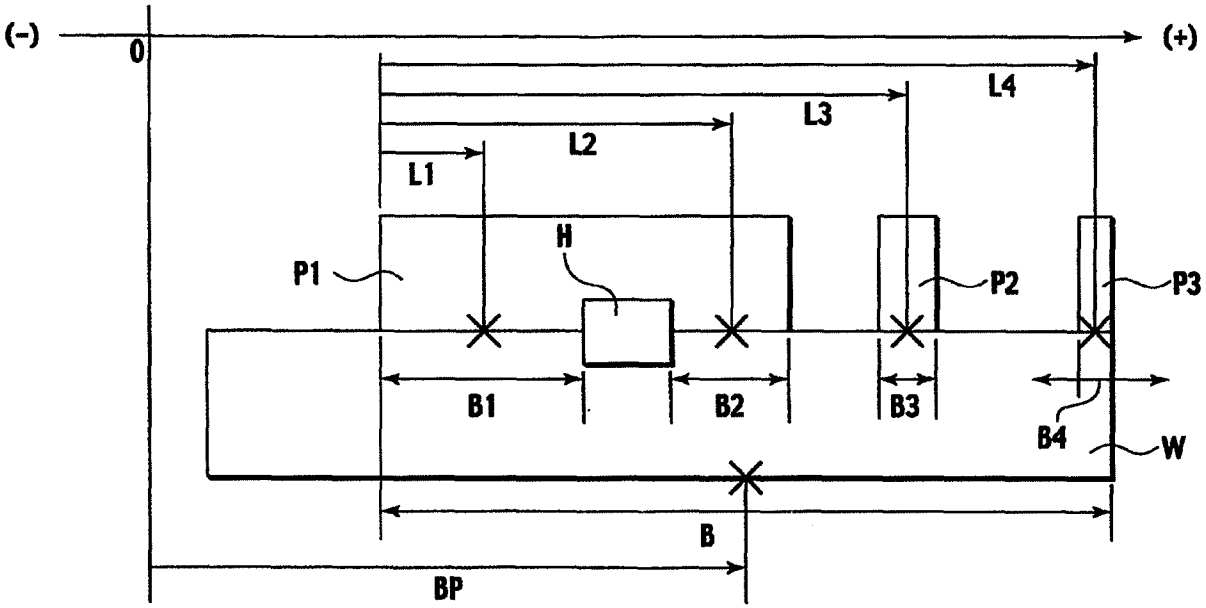
FIG. 4 is a view for explaining actual bending line lengths and a bending gravity center position in accordance with a shape of a work.

Incidentally, concerning the work subjected to bending, a bending line of the work W is not always continuous. For example, as shown in FIG. 4, there is a case of a configuration of a work W including protrusions P1, P2 and P3, and a hole H. In this case, lengths of bending lines of portions corresponding to the protrusions P1, P2, and P3 are equal to B1 and B2, B3, and B4, respectively, and a bending line length A becomes equal to (B1+B2+B3+B4).

Here, a total length of the bending lines ranging from the protrusions P1 to P4 is defined as B, a dimension from the center O in the left-to-right direction of the bending machine to the center of the bending line B is defined as BP, and dimensions from one end of the protrusion P1 to the centers of each bending line B1, B2, B3 and B4 are respectively defined as L1, L2, L3 and L4. Then, a bending gravity center position AP on the whole is expressed as:

$$AP = \{\{(B1*(L1 - B/2 + BP)) + (B2*(L2 - B/2 + BP)) + (B3*(L3 - B/2 + BP)) + (B4*(L4 - B/2 + BP))\}/A$$

Thus, when bending is performed along each bending line B1, B2, B3 and B4, the pressures necessary for the left and right pressurizing means 13 are calculated on the assumption that the total pressure for performing bending at the bending line length A is applied to the bending gravity center position AP.

As described above, the correction of the inclination of the ram 5 is achieved by correcting in line with the actual bending processes by calculating the actual bending length, calculating the actual bending gravity center position, and calculating and dividing the pressures necessary for the left and right pressurizing means 13 on the assumption that the total pressure is applied to the actual bending gravity center position. Hence it is possible to perform the bending at higher accuracy.

Note that the correction of the inclination of the ram 5 has been mainly described in the explanation of this embodiment. However, in the case of performing crowning correction (correction to bend the central part of the lower table 7 into a convex shape in an upward direction) of the ram 5 or the lower table 7, it is also desirable to calculate the actual bending length and the bending gravity center position and to perform the crowning correction in consideration of the pressure required for the left and right pressurizing means by calculating the actual bending length and bending gravity center position as described above.

Next, second to fifth embodiments according to the present invention will be described by use of the accompanying drawings. Here, the case of bending a sheet-shaped work into a V shape will be described in order to facilitate understandings.

Figure 5:
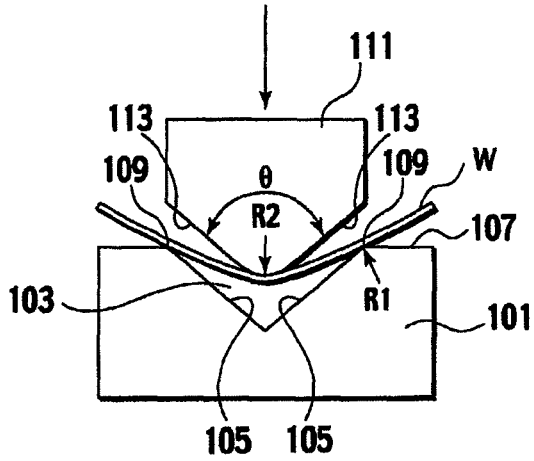
FIG. 5 is a view for explaining an action when bending a work by use of a punch and a die according to a second embodiment of the present invention.

As shown in FIG. 5, a die body 101 of a die used for bending a sheet-shaped work W into a V shape includes a V-shaped bending groove (a V groove) 103, and intersections of inclined planes (inclined surfaces) 105 on both sides of this bending groove 103 with an upper surface 107 of the die body 101 constitute shoulders 109. These shoulders 109 are formed into curved surfaces in the shape of arcs each having a minute radius R1 (such as 0.8 mm). Moreover, a small concave portion may be provided at a bottom of the V groove 103 which constitutes an intersection of the two inclined surfaces 105 as appropriate.

A punch 111 rendered freely engageable with the bending groove 103 in the die body 101 includes inclined surfaces (inclined planes) 113 which are provided on the tip end side thereof and which are parallel to the inclined surfaces 105 of the bending groove 103, and an angle of a tip end side (a tip end angle) θ of the punch 111 is formed equal to an angle of the V groove (the bending groove) 103 in the die body 101. Moreover, the tip end portion of the punch 111 is formed into a curved surface in the shape of an arc having a small radius R2. The width dimension of the punch 111 is formed equal to a V width of an upper plane of the bending groove 103 in the die body 101, i.e. a dimension of a space between the shoulders 109.

Figure 6:
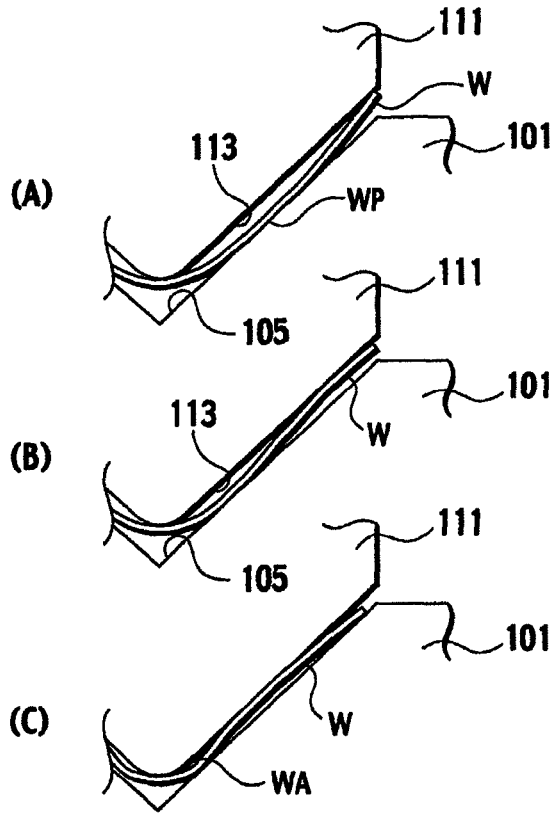
FIG. 6 is a view for explaining behaviors of the work when bending the work by use of the punch and the die.

In the above-described configuration, when the work W is placed on an upper surface 7 of the die body 101, and concurrently when the work W is pressed into the bending groove 3 in the die body 101 by use of the tip end portion of the punch 111, the work W is bent in a state of being supported by the shoulders 109 of the die body 101 as shown in FIG. 5. Moreover, as the pressurization (pressing) by the punch 111 progresses, the work W exhibits behaviors (phenomena) as shown in FIG. 6 in a space between the punch 111 and the die body 101.

Specifically, the state in FIG. 6(A) is the state where a supporting point for the work W moves from the shoulder 109 of the die body 101 to the inclined surface 105 of the bending groove 103, and where the work W contacts (abuts on) the inclined surface 113 of the punch 111 in a position above a contact position WP between the work W and the inclined surface 105. In the state shown in this FIG. 6(A), the bending angle for the work W is an angle smaller than the angle of the bending groove 103 in the die body 101 and the tip end angle θ of the punch 111.

Thereafter, as the pressing by the punch 111 progresses further, the contact position WP between the work W and the inclined surface 105 gradually moves downward (to the bottom of the V groove) while the upper side of the work W is bent back as shown in FIG. 6(B), and contacts again in the vicinity of the upper portion of the inclined surface 105 of the die body 101 as shown in FIG. 6(C). Then, the coining is ultimately performed by sandwiching and pressurizing the work W strongly in the space between the inclined surface 105 of the die body 101 and the inclined surface 113 of the punch 111. Here, if a minute clearance WA exists between the punch 11 and the work W, it constitutes an unstable factor for the bending angle. Accordingly, an extremely high pressure is required to eliminate the clearance WA.

Figure 7:
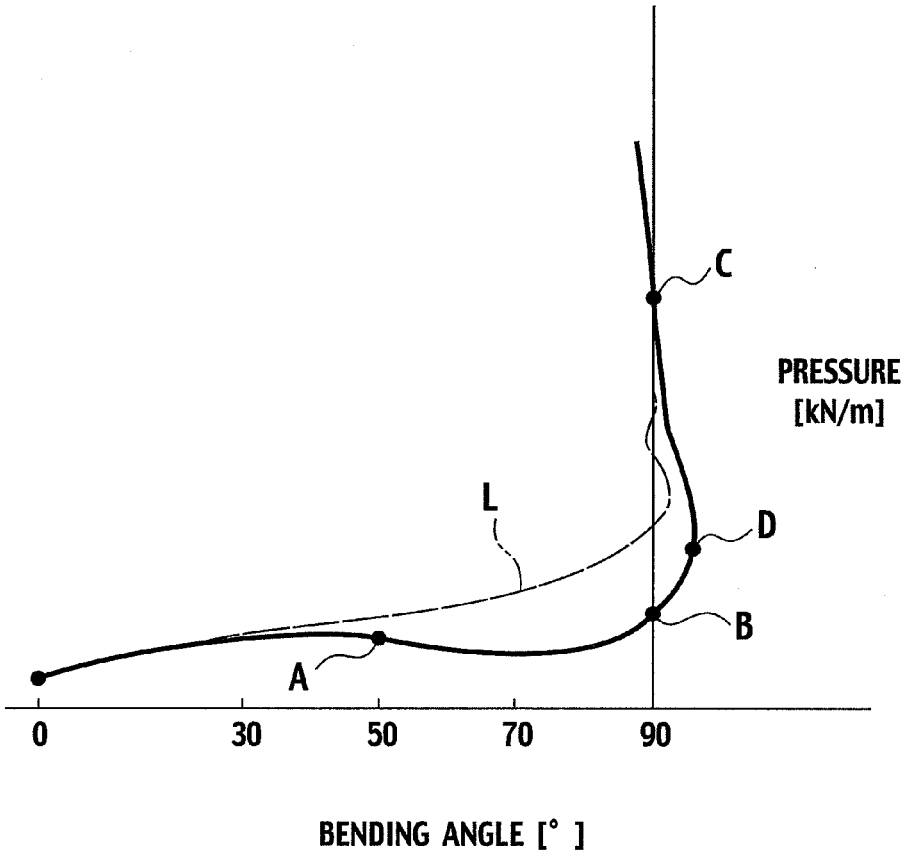
FIG. 7 is a view for explaining a relation between a bending angle and a pressure when bending the work by use of the punch and the die.
Figure 8:
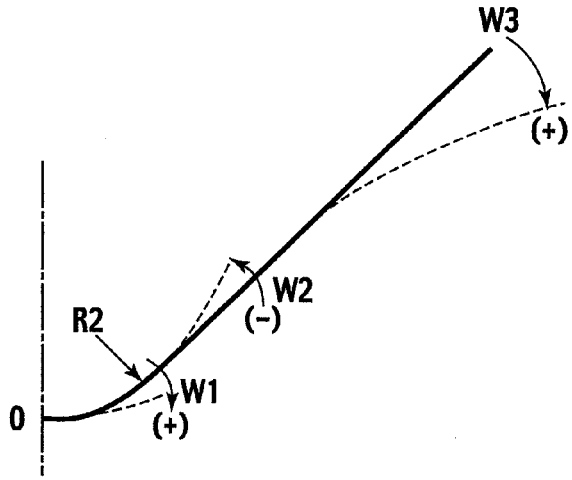
FIG. 8 is a view for explaining spring-back and spring-in of the work.
Figure 13:
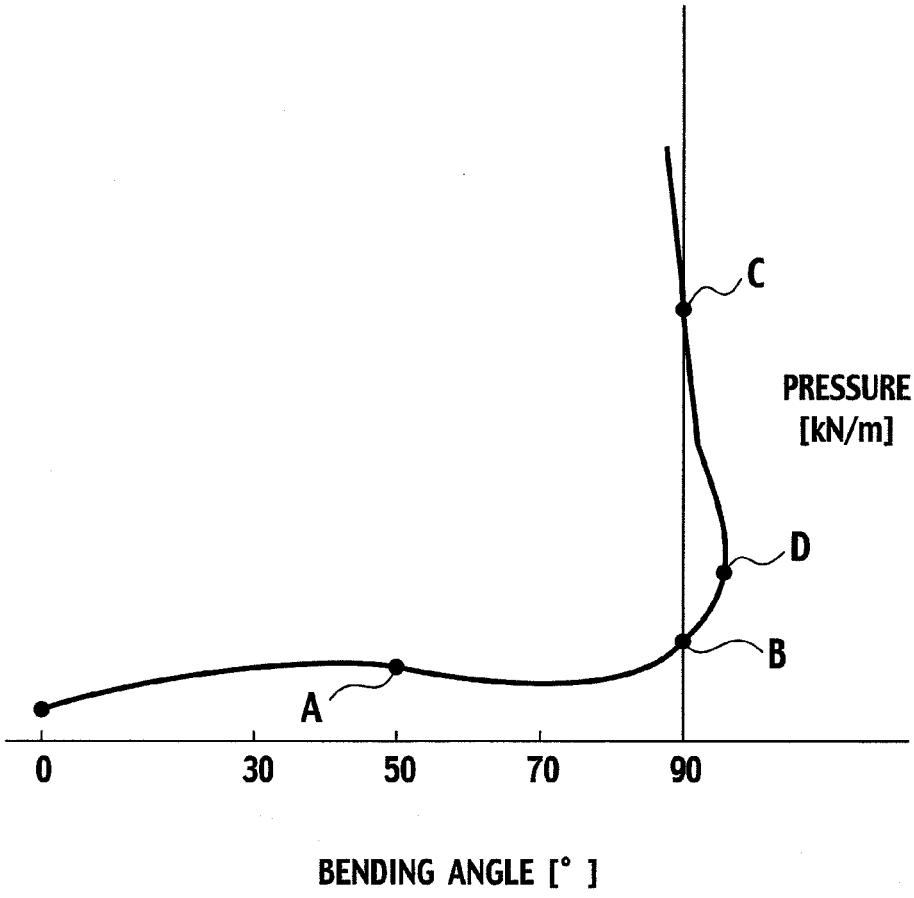
FIG. 13 is a view for explaining the relation between the bending angle and the pressure when bending the work by use of the punch and the die.

As it is well known, a relation between angle variation of the work W and the pressure from the initiation of bending the work W is indicated as shown in FIG. 13 (FIG. 7). Note that, although the above-described behaviors of the work W or the relation between the bending angle for the work and the pressure varies in accordance with the material and the sheet thickness of the work and with the shape and the dimensions of the punch and the die, but generally brings about the phenomena as described above. In FIG. 13 (FIG. 7), a region A is an air bending region, B is a bottoming region, and C is a coining region. Note that FIG. 7 is obtained by adding an L curved line onto a graph in FIG. 13.

Moreover, a D region where the bending angle for the work W becomes smaller than the bending angle of 90° (in the case where the angles of the V groove in the die and the tip end angle of the punch are equal to 90°) and then returns to 90° again is a region corresponding to the processes illustrated in FIGS. 6(A) to 6(C), namely, an over-bending region.

As described previously, a portion 0-W1 representing a portion where the work W fits in the tip end radius R2 of the punch 111 by coining the work W is the portion of spring-back (positive spring-back) so as to increase the bending radius, i.e. to open the work W. A portion W1-W2 is the bending-back portion, as shown in FIGS. 6(A) and 6(B), causing spring-back (negative spring-back) so as to close the work W. Moreover, a portion W2-W3 is a portion deformed so as to contact the inclined surface 113 of the punch 111 by pressurization as shown in FIG. 6(C), which represents positive spring-back.

If a sum of the spring-back in each of the regions of 0-W1, W1-W2, and W2-W3 is equal to 0, the spring-back is equal to 0. When the positive spring-back is dominant, the work W generates the spring-back so as to increase the angle thereof upon removal of the pressure by the punch 111 and the die body 101. Meanwhile, when the negative spring-back is dominant, the work W is deformed so as to reduce the angle thereof (spring-go, spring-in) upon removal of the pressure.

As understood already, when the bottoming or the coining is performed by sandwiching and pressurizing the work by use of the inclined surfaces 105 of the V groove 3 in the die body 101 and the inclined surfaces 113 of the punch 111, the work W is pressurized by the entire surfaces of the inclined surfaces 105 and 113. Accordingly, a pressurizing unit having high output is required to apply the pressure, necessary for the bottoming or the coining, to the entire surfaces of the relatively wide inclined surfaces 105 and 113. Moreover, it is necessary to increase rigidity of a frame of the bending machine (the press brake) so as to possibly deal with the bottoming or the coining.

Specifically, when bending the work W by the coining, it is necessary to construct the frame of the bending machine with high rigidity in advance so as to possibly deal with a large load at the time of coining, resulting in high costs. Accordingly, there has been a demand for enabling the bending machine, which is configured to bend the work W by the air bending or the bottoming, to bend the work W by the coining as well while retaining the original rigidity of the frame.

Figure 9:
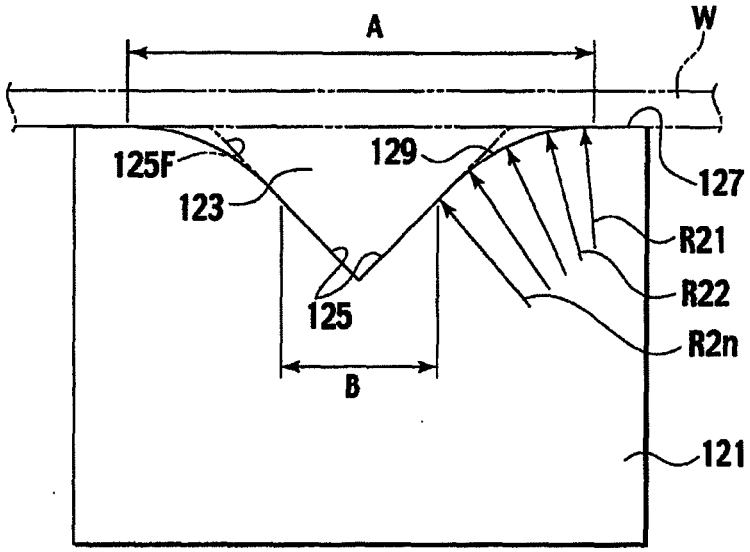
FIG. 9 is a view for explaining a die according to an embodiment of the present invention.

In view of the foregoing, the die according to the embodiment of the present invention has the following configuration. Specifically, as shown in FIG. 9, a die body 121 includes inclined planes (inclined surfaces) 125 provided on both sides of the vicinity of bottom portions of side surfaces on both sides forming a V-shaped bending groove (a V groove) 123, and these inclined planes 125 are connected to upper surfaces 127 constituting upper planes of the die body 121 through curved surfaces 129 connected to contact the inclined planes 125 and the upper surfaces 127. A contact plane on an uppermost part of the curved surface 129 is a plane coinciding with the upper surface 127, while a contact plane on a lowermost part of the curved surface 129 is a plane coinciding with the inclined plane 125. Moreover, the curved surface 129 is formed into a convex curved surface in which curvature radii R22 to R2*n* on a lower side of the curved surface 129 gradually become greater than a curvature radius R21 on an upper side thereof. Note that the curvature radii R22 to R2*n* are larger radii than the radius of the shoulder R in the typical conventional die, which are the large radii in a range from about 1 mm to 10 mm.

Moreover, when an interval between the positions connecting the upper surfaces 127 of the die body 121 to the curved surfaces 129 (a V width on the uppermost part of the bending groove 123) is defined as a dimension (a V-width dimension) A, and when an interval between the positions connecting the inclined planes 125 of the V groove (the bending groove) 123 to the curved surfaces 129 is defined as a dimension (a width dimension of the upper part of the inclined planes 125) B, A and B are set to satisfy about $2 \leqq A/B \leqq 4$.

Specifically, the V-width A of the V groove 123 in the die body 121 is generally set to a size about 5 to 8 times as large as the sheet thickness of the target work W. Moreover, since a bending process of the work W is usually intended for bending at 90°, the target angle of the V groove 123 in the die for performing a bending process such as the coining is generally set to 90°. Furthermore, when the bending is performed by sandwiching and pressurizing the work W by use of the inclined planes 125 of the V groove 123 in the die body 121 and the inclined surfaces 113 of the punch 111, and if a perpendicular line is drawn from the center of the tip end radius R2 of the punch 111 to the inclined plane 125 of the die body 121, a high pressure is applied to (a stress is increased at) a region in the vicinity of this perpendicular line.

Therefore, when performing the bending work such as the coining, it is desirable to define about $2 \leqq A/B$ in order to secure, to some extent, a region where the high pressure is applied to the work W (a region where the stress is increased). Here, if $2 > A/B$ holds true, a spread of the inclined plane 125 of the V groove 123 is increased, and it is thereby necessary to increase the pressure at the time of the bending such as the coining, which is undesirable because a size increase of the pressurizing unit is incurred.

In contrast, if $A/B > 4$ holds true, the spread of the inclined plane 125 of the V groove 123 is reduced, and the region for generating the large stress on the work at the time of bending the work becomes smaller, which is undesirable.

In the above-described configuration, when the work W is subjected to bending by using the punch 111 having similar conditions to the above description and by pressing the work W placed on the upper surface 127 of the die body 121 into the V groove 123, supporting points for the work W on the die body 121 (the contact positions of the work W and the two side surfaces of the V groove 123) gradually move downward along the curved surfaces 129. Then, the work W is sandwiched and pressurized by the inclined planes 125 of the V groove 123 in the die body 121 and the inclined surfaces 113 of the punch 111. By increasing the pressure of the punch 111 in this sandwiched and pressurized state, the work W is bent by means of the bottoming, the coining, or the like.

Incidentally, when the work W is bent as described above, a bent portion of the work W is bent into a larger radius than the tip end radius R2 of the punch 111 in the beginning as shown in FIG. 5 to FIG. 6. Thus, on both sides of the abutting positions WP (see FIG. 6) between the inclined surfaces 105 on both sides of the V groove 103 in the die 101 and the work W, the work W abuts on the inclined surfaces 113 of the punch 111 (See FIG. 6(A)), and is thereby bent back.

Here, when the upper side of the inclined surface 105 is formed into the curved surface 129 as shown in FIG. 9, the curved surface 129 is located outside a contact plane 125F being in contact with the inclined surface 125, and the upper side of the curved surface 129 recedes from the contact plane 125F as the curved surface 129 extends upward. Thus, the upper side of the curved surface 129 is located away from the inclined surface 113 of the punch 111. Accordingly, the position where the work W abuts on the curved surface 129 is located away from the inclined surface 113 of the punch 111 as compared to the case of the inclined surface 105. Hence, assuming the curvature of the bent portion of the work W to be bent by the pressure of the tip end portion of the punch being equal, the time when both sides of the work W abut on the punch 111 is delayed in the case where the curved surfaces 129 are formed on the upper side of the inclined surfaces 105 (the case of the configuration shown in FIG. 9) as compared to the case where the inclined surfaces 5 are formed on the two sides of the V groove 103 entirely.

In other words, in the case of the configuration of the die body 121, both sides of the bent portions of the work W abut on the inclined surfaces 113 of the punch 111, and are thus bent back, after more progress of bending the work W as compared to the case of the configuration of the die body 101. Specifically, as compared to the case of using the general die body 101, the bending process using the die body 121 according to this embodiment makes it possible to reduce energy required for bending back and to suppress the pressure at the time of the bending process such as the bottoming or the coining.

As described above, when the work W is bent by use of the die body 121 and the punch 111, the contact positions between the work W and the die body 121 (the supporting positions for the work W by the die body 121) gradually move downward (toward the bottom of the V groove) along the curved surfaces 129. Thereby, the dimension of the interval between the supporting points where the work W is supported by the die body 121 gradually becomes smaller, and the pressure from the punch 111 is gradually increased as a consequence. Then, as both sides of the bent portions of the work W abut on the inclined surfaces 113 of the punch 111, the bending angle for the work W becomes smaller than the angle of the V groove 123 in the die body 121. Thereafter, the bending back occurs, and the bending process such as the bottoming or the coining is performed.

Therefore, the relation between the bending angle for the work W and the pressure is shown as the relation indicated by the curved line L in FIG. 7, in which the bending back amount is smaller than those of the conventional and general cases of the bottoming and the coining, and the energy necessary for bending back becomes smaller.

As understood already, according to this embodiment, when the work W is bent by use of the punch 111 and the die body 21, the contact positions between the work W and both side surfaces of the V groove 123 in the die body 121 (the supporting positions for the work W by the die body 121) are moved toward the bottom side of the V grove 123, i.e. the interval between the supporting positions is gradually reduced, while retaining the state of three-point bending (the air bending), and eventually, the work W is sandwiched and locally and strongly pressurized in the space between the inclined planes 125 provided on the bottom side of the V groove 123 and the inclined planes on the tip end side of the punch 111.

In other words, as shown in the curved line L in FIG. 7, the pressure is gradually raised (increased) without reduction from the initiation of bending the work W to the transition to the bottoming or the coining. Therefore, if conditions for the punch 111, the die body 121 and the work W are constant, it is possible to find the relation between the bending angle for the work W and the pressure unambiguously in the form of linkage therebetween. Hence, it is not necessary to perform trial bending at the time of bending the work W in the next session while applying the identical conditions, and it is thereby possible to improve the efficiency. Note that, it is desirable to set the linear relation between the bending angle for the work W and the pressure. This can be achieved by forming the curved line 129 into an appropriate shape.

Accordingly, it is also possible to set constant the curvature radii of the curved surfaces 129 while retaining constant the width dimension B of the inclined planes 125. However, when the curvature radii of the curved surfaces 129 are set constant, the curved surfaces 129 will exhibit arcs having large radii, and the V-width dimension A becomes greater, which is not desirable. Then, the curvature radii of the curved surfaces 129 may be set to constant small radii so as to make the V-width dimension A smaller. In this case, the V groove 123 becomes shallower, and a width dimension (a dimension from the bottom of the V groove 123 to the upper surface 27) of the side surfaces (the surfaces including the inclined planes 125 and the curved surfaces 129) constituting the V groove 123 is reduced.

Accordingly, when the work W is bent by use of a die body including the V width 123 having the V-width dimension A=B, both side portions in the vicinity of the bending portions of the work W do not abut on the side surfaces of the V groove 123, and do not receive the bending-back action (see FIG. 6) in the bending proves of the work W in some cases. Thus, when the pressure is removed after the work W is bent by bottoming or coining, only the positive spring-back W1 shown in FIG. 8 will act on the work W.

Hence, when the work W is bent by bottoming, coining or the like while the angle of the V groove 123 in the die body 121 and the tip end angle of the punch 111 are set equal to the bending angle defined as the target angle, the work W follows the angle of the V groove 123 in the die body 121 and the tip end angle of the punch 111, but is not over-bent to an angle smaller than the angle of the V groove 123 and the tip end angle. Accordingly, the bending angle for the work detached from the punch and the die always becomes greater than the target angle due to the spring-back. Hence it is difficult to achieve accurate bending.

As understood from the above description, when the work W is bent into the V shape by use of the die body 121 and the punch 111, the portions of the die body 121 that strongly sandwich and pressurize the work W are the portions of the inclined planes 125 which are relatively narrow regions in the vicinity of the bottom of the V groove 123. Accordingly, only both side portions close to the bending line defined by bending the work W into the V shape are locally pressurized. Hence it is possible to reduce the pressure necessary for the bending such as the bottoming or the coining as compared to the case of the conventional die configured to allow the work W to abut on the entire side surfaces (the side surfaces corresponding to the inclined surfaces 105 of the die body 101 shown in FIG. 5) of the V groove 123.

Meanwhile, in the die body 121, the curved surfaces 129 formed on the upper side of the inclined planes 125 provided on the bottom side of the V groove 123 is formed into the convex curved surface in which the curvature radii on the lower side become greater than the curvature radii on the upper side. Therefore, it is possible to reduce the V-width dimension A of the V groove 123, and to deal with the case where the work W targeted for bending has the small width dimension.

Figure 10:
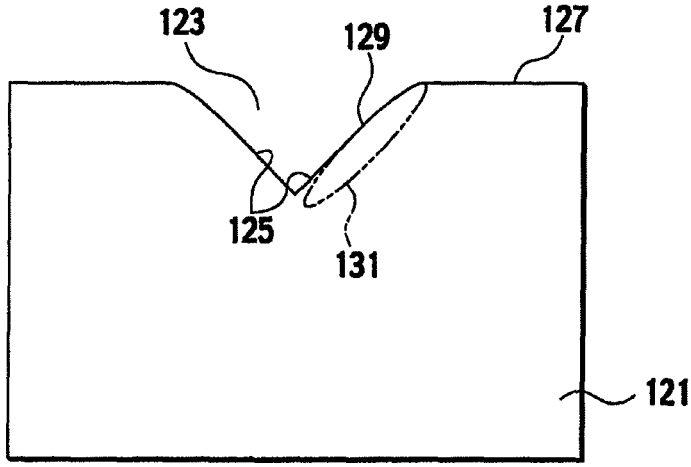
FIG. 10 is a view for explaining a die according to a third embodiment of the present invention.

FIG. 10 shows a third embodiment. In this third embodiment, the inclined plane 125 and the upper surface 127 of the V groove 123 in the die body 121 are connected to each other by use of an ellipse 131. Note that a contact position between the ellipse 131 and the inclined plane 125 is located in the vicinity of a substantially intermediate position of the depth from the upper surface 127 of the V groove 123. In this configuration, the curved surface 129 on the upper side of the inclined plane 125 is formed into the convex curved surface, and is able to achieve similar effects to the foregoing.

Figure 11:
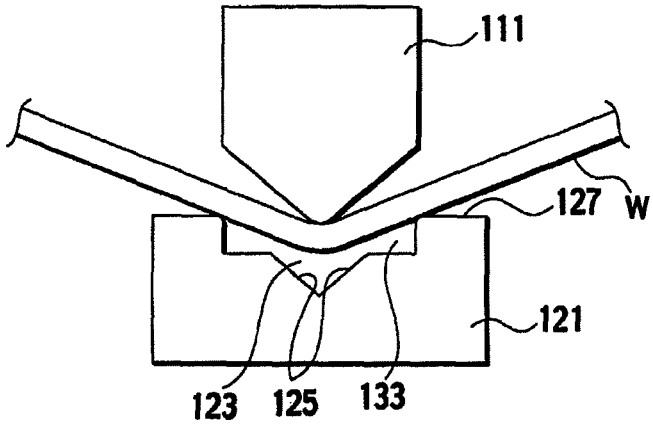
FIG. 11 is a view for explaining a die according to a fourth embodiment of the present invention.
Figure 11:
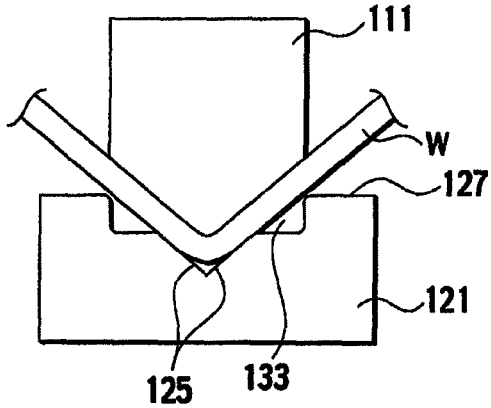

FIG. 11 shows a fourth embodiment. This fourth embodiment has a configuration to form concave portions 133 of an appropriate shape by removing the curved surfaces 129 between the inclined planes 125 and the upper surface 127 of the V groove 123 in the die body 121. In this configuration, bending is performed in the beginning of bending the work W by using three points of the shoulders (the curved surfaces having small radii) of the V groove 123 and the punch 111 (see FIG. 11(A)). Then, as the bending process of the work W progresses, the portions of the work W in the vicinity of the bent portion contact the upper parts of the inclined planes 125, and in terms of a relation with the die body 121, the work W is in the state of contacting the upper parts of the inclined planes 125 and the shoulders of the V groove 123 (the three-point bending state). Thereafter, as the bending process of the work W further progresses, the work W is slightly detached from the shoulders of the V groove 123 and the strong pressure is applied locally to the work W between the inclined planes 125 and the punch 111, so that the bending process such as the bottoming or the coining is performed. This configuration can also achieve the effects as described above.

Figure 12:
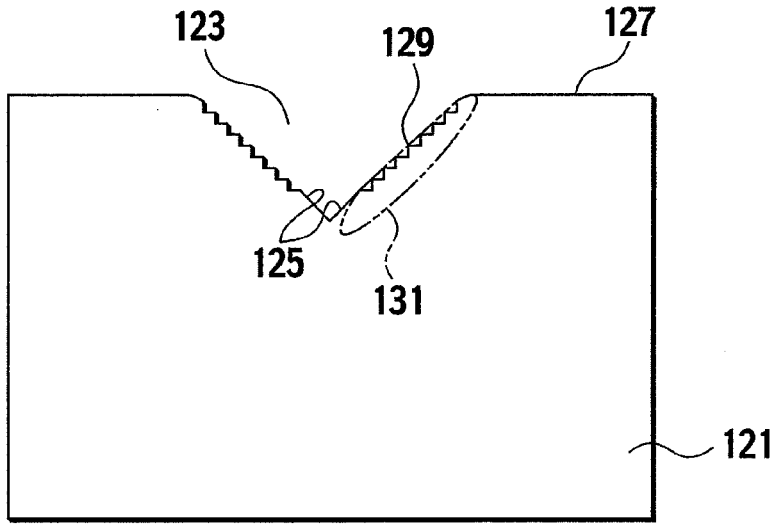
FIG. 12 is a view for explaining a die according to a fifth embodiment of the present invention.

As understood already, the bending process such as the bottoming or the coining is performed by strongly pressurizing the work W in the vicinity of the bent line locally by use of the inclined surfaces 125 on the bottom side of the V groove in the die body 121 and the inclined surfaces 113 of the tip end side of the punch 111. Accordingly, it is possible to form the sides of the V groove 123 extending from the inclined surfaces 125 to the upper surfaces 127 of the die body 121 into the above-described concave portions 133 and the like. In other words, it is possible to form the side surfaces of the V groove 123 extending from the inclined surfaces 125 to the upper surfaces 127 into an arbitrary shape located outside the contact planes 125F (see FIG. 9) being in contact with the inclined surfaces 125. For example, as shown in FIG. 12, it is also possible to form the aspect of the curved surfaces 129 into step-like pattern being in contact with the ellipse 131. That is, the side surface portion corresponding to the curved surface 129 can be formed into various aspects by means of design changes and the like.

The first to fifth embodiments of the present invention have been described above. Now, still another embodiment having a radius of a tip end R (R3) of the punch further increased from the tip end R (R2) will be described below.

First, as understood by the foregoing description, when bending the work W, there is no negative spring-back but the positive spring-back exists in the case where there are no regions where a bending angle is smaller than the target bending angle (such as 90°), i.e. there is not the over-bending region (the D region) or in the case of the air-bending region A, for example. For this reason, in this case, it is necessary to bend the work W smaller than the target bending angle in consideration of the spring-back. Hence, when the target bending angle is, for example, equal to 90°, it is necessary to set the angle of the V groove 103 in the die 101 and the tip end angle θ of the punch 111 smaller than the target angle (such as 88°) in advance.

In the case of the bottoming, the pressure is released in the over-bending region D where the bending is performed in excess of the target angle (such as 90°). Accordingly, the positive spring-back and the negative spring-back exist in the cast of the bottoming, and the spring-back amount is reduced. Thus, it is possible to perform bending at higher accuracy as compared to the case of the air-bending. However, in the case of the bottoming, the above-described minute clearance WA exists between the punch 111 and the work W. Hence, an unstable factor for the bending angle exists herein, and it is thereby difficult to stably perform the bending process at high accuracy.

The coining is configured to perform bending back of the over-bending after the over-bending is performed in excess of the target angle (such as 90°), and to transfer the inclined surfaces 105 of the V groove 103 in the die 101 and the inclined surfaces 113 of the punch 111 to the work W by sandwiching and pressurizing the work W extremely strongly in the space between the inclined surfaces 105 of the die 101 and the inclined surfaces 113 of the punch 111. Therefore, it is possible to bend the work W accurately at the target angle by presetting the angle of the V groove 103 in the die 101 and the tip end angle θ of the punch 111 equal to the target angle.

Here, if the over-bending amount is large when the coining is performed, the energy required for bending back this over-bending becomes large, and it is thereby necessary to increase the pressure when bending the work W. In other words, if the over-bending amount becomes smaller, and then the bending-back amount becomes smaller, and it is thereby possible to suppress the pressure to a small level at the time of the coining.

Accordingly, in the case of performing the coining of the work W while forming the angle of the V groove 103 on the die 1 and the tip end angle θ of the punch 111 equal to the target bending angle for the work W in advance, it was found out that the over-bending amount was able to be reduced and that the pressure at the time of the coining was able to be further reduced by setting the tip end R (R2) of the punch 111 equal to a specific radius.

Figure 14:
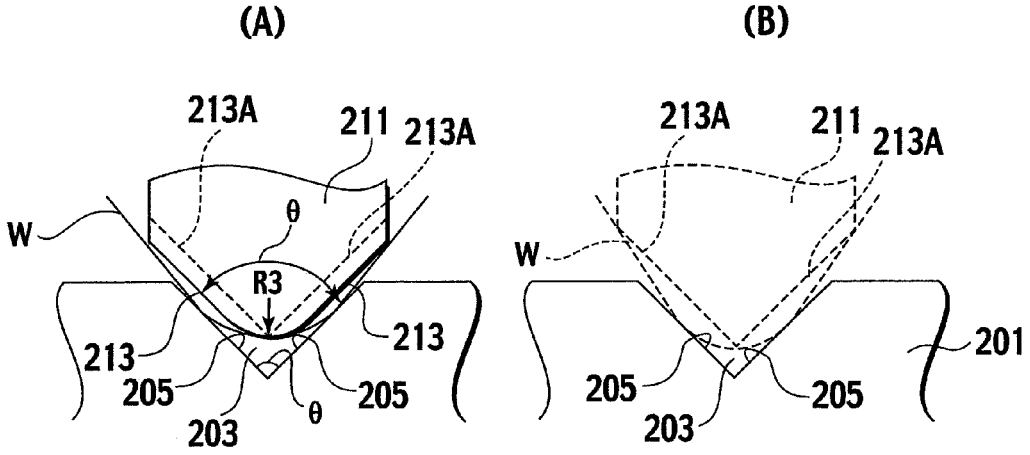
FIG. 14 is a view for explaining a punch and a die according to an embodiment of the present invention.

As described above, a punch 211 according to still another embodiment having the radius of the tip end R (R3) which is further increased from the tip end R (R2) will be described below with reference to FIG. 13 to FIG. 15.

As shown in FIG. 14(A), when an angle θ of a V groove 203 in a die 201 and a tip end angle θ of the punch 211 are formed equal to the target bending angle (such as 90°) intended for bending the work W in advance, and the work W is subjected to bending with the punch 211 and the die 201, the work W is bent by the air bending in the beginning, and is bent at the target bending angle (position B in FIG. 7 and FIG. 13) when moving to the over-bending region. Then, the work W is bent at an angle smaller than the target bending angle (over-bending, see FIG. 6(A)).

In the over-bending state as described above, the radius of the bent portion of the work W is larger than the radius (a radius larger than R2 in FIG. 5) than the tip end R (R3) of the punch 211. Moreover, part of the work W is in the state of abutting on (contacting) the vicinity of upper parts of inclined surfaces 213 of the punch 211. In this state, when the punch 211 is relatively pressed into the V groove 203 in the die 201, upper parts of the work W are bent back outward.

Here, when the tip end R of the punch 211 is formed into a smaller radius, i.e. when setting a minute radius as indicated by a broken line in FIG. 5(A), inclined surfaces 13A indicated with broken lines and the work W are separated, so that it is possible to bend the work W at a smaller angle. Moreover, as shown in FIG. 5(B), the over-bending reaches the maximum when part of the work W abuts on the inclined surfaces 213A of the punch 211.

As understood from the above description, the over-bending amount of the work W becomes greater as a difference between an inside radius (inner diameter, inner R) of the work W when the work W is bent by the air bending and the tip end R (R3) of the punch 211 becomes greater. In other words, the over-bending amount becomes small when the difference between the inner R of the work W at the time of the air bending and the tip end R of the punch 211 is small.

Accordingly, the air bending amount becomes equal to zero when the inner R of the work W at the time of the air bending is set equal to the radius of the tip end R of the punch 211. In this case, the above-described negative spring-back does not occur. Accordingly, it is not desirable to set the inner R equal to the tip end R. Therefore, in order to suppress the over-bending amount to a small level, the air bending of the work W may be performed under the condition of forming both the angle of the bending groove 203 in the die 201 and the tip end angle of the punch 211 equal to the target bending angle for the work, and the tip end R of the punch 211 may be formed into a radius slightly smaller than the inner R of the work W when the work W is bent at the target bending angle for the first time.

Figure 15:
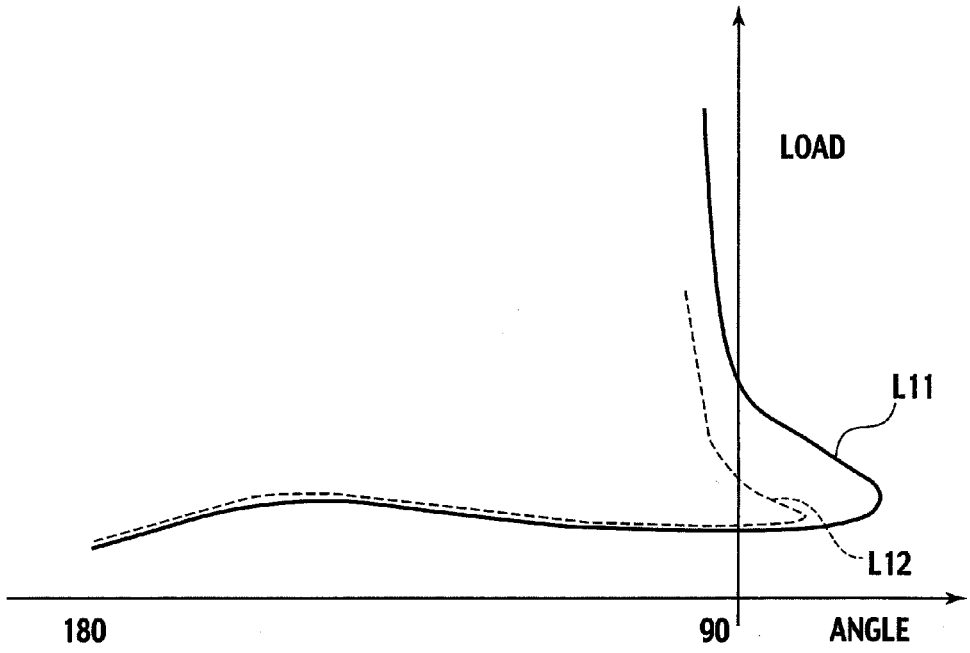
FIG. 15 is a view for explaining a relation between a bending angle and a pressure when bending a work by use of a punch and a die.

By applying this configuration, concerning the over-bending amount of the work W, it is possible to reduce the over-bending amount less than that of the usual general coining (L11) as indicated, for example, with a broken line L12 in FIG. 15. Since the bending-back amount is reduced, it is possible to reduce the pressure at the time of the coining.

Incidentally, although the tip end R (R3) of the punch 211 for performing the coining is generally set to about 0.2 mm, it is desirable to set to about 0.8 mm. Specifically, although the over-bending amount varies in response to the sheet material, the sheet thickness and the target bending angle for the work W subject to bending, according to experiments, it is possible to retain the over-bending amount substantially within a constant range relative to the various materials, sheet thicknesses and target bending angles by setting the tip end R of the punch 211 about 0.8 mm (0.7 mm to 0.9 mm). In particular, a significant effect is achieved in the case of SPCC having a sheet thickness of 1 mm.

When the tip end R of the punch 211 is about 0.8 mm or less, the over-bending amount tends to be increased. Meanwhile, when it is about 0.8 mm or more, the over bending does not occur from time to time. Therefore, it is desirable to set the tip end R of the punch 211 about 0.8 mm.

Besides the above description, the present invention is not limited only to the aforementioned description of the embodiments of the invention, and can be embodied in various other aspects by applying appropriate modifications.

Note that the entire contents of Japanese Patent Applications No. 2004-333594 (filed on Nov. 17, 2004), No. 2004-363445 (filed on Dec. 15, 2004), No. 2005-244464 (filed on Aug. 25, 2005), and No. 2005-244542 (filed on Aug. 25, 2005) are incorporated herein by reference.

The invention claimed is:

1. A bending machine having a punch and a die for bending a sheet-shaped work, a ram rendered vertically movable for vertically moving any of the punch and the die, and pressurizing module which pressurizes the work in a space between the punch and the die by vertically moving the ram, comprising:

an inputting module which inputs die information on the punch and the die, material information on a work, and bending information;

a database storing data on a pressure per unit length required for bending the work;

a first calculating module which calculates a total pressure necessary for the pressurizing module based on various information inputted from the inputting module and on the data on the pressure stored in the database;

a second calculating module which calculates a pressure necessary for the left and right pressurizing module based on the total pressure calculated by the first calculating module and on layout position information on the work relative to the bending machine; and a controlling module which controls the left and right pressurizing module based on the result of calculation by the second calculating module.

2. A bending machine having a punch and a die for bending a sheet-shaped work, a ram rendered vertically movable for vertically moving any of the punch and the die, and pressurizing module which pressurizes the work in a space between the punch and the die by vertically moving the ram, the pressurizing module provided on both left and right sides of the bending machine, comprising:

an inputting module which inputs die information on the punch and the die, material information on a work, and bending information;

a database which stores data on a pressure per unit length required for bending various works;

a first calculating module which calculates a total pressure required by the pressurizing module based on the various information inputted from the inputting module and on the data on the pressure stored in the database;

a second calculating module which calculates a pressure necessary for the left and right pressurizing module based on the total pressure calculated by the first calculating module and on layout position information on the work relative to the bending machine;

a third calculating module which calculates amounts of strain of two side frames of the bending machine based on a result of calculation by the second calculating module, and which calculates an inclined angle of the ram; and a controlling module which controls the left and right pressurizing module to correct the inclined angle of the ram, calculated by the third calculating module, to an opposite inclined angle, and which controls the left and right pressurizing module based on the result of calculation by the second calculating module.

3. A bending machine having a punch and a die for bending a sheet-shaped work, a ram rendered vertically movable for vertically moving any of the punch and the die, and pressurizing module which pressurizes the work in a space between the punch and the die by vertically moving the ram, comprising:

an inputting module which inputs die information on the punch and the die, material information on a work, and bending information;

a first calculating module which calculates a total pressure necessary for bending the work based on the die information, the material information, and the bending information;

a second calculating module which calculates a pressure necessary for the left and right pressurizing module based on the total pressure calculated by the first calculating module and on layout position information on the work relative to the bending machine; and a controlling module which controls the left and right pressurizing module based on the result of calculation by the second calculating module.

4. A bending machine having a punch and a die for bending a sheet-shaped work, a ram rendered vertically movable for vertically moving any of the punch and the die, and pressurizing module which pressurizes the work in a space between the punch and the die by vertically moving the ram, the pressurizing module provided on both left and right sides of the bending machine, comprising:

an inputting module which inputs die information on the punch and the die, material information on a work, and bending information;

a first calculating module which calculates a total pressure necessary for bending the work based on the various information inputted from the inputting module;

a second calculating module which calculates a pressure necessary for the left and right pressurizing module based on the total pressure calculated by the first calculating module and on layout position information on the work relative to the bending machine;

a third calculating module which calculates amounts of strain of two side frames of the bending machine based on a result of calculation by the second calculating module, and which calculates an inclined angle of the ram; and a controlling module which controls the left and right pressurizing module to correct the inclined angle of the ram, calculated by the third calculating module, to an opposite inclined angle, and which controls the left and right pressurizing module based on the result of calculation by the second calculating module.

* * * * *